US008648688B2

(12) United States Patent
Kimura et al.

(10) Patent No.: US 8,648,688 B2
(45) Date of Patent: Feb. 11, 2014

(54) PROTECTION ELEMENT

(75) Inventors: Yuji Kimura, Nomi (JP); Kazuaki Suzuki, Nomi (JP)

(73) Assignee: Dexerials Corporation, Tokyo (JP)

( * ) Notice: Subject to any disclaimer, the term of this patent is extended or adjusted under 35 U.S.C. 154(b) by 82 days.

(21) Appl. No.: 13/145,465

(22) PCT Filed: Jan. 14, 2010

(86) PCT No.: PCT/JP2010/050336
§ 371 (c)(1),
(2), (4) Date: Jul. 20, 2011

(87) PCT Pub. No.: WO2010/084819
PCT Pub. Date: Jul. 29, 2010

(65) Prior Publication Data

US 2011/0279219 A1 Nov. 17, 2011

(30) Foreign Application Priority Data

Jan. 21, 2009 (JP) ..... 2009-11198

(51) Int. Cl.
*H01H 85/04* (2006.01)
*H01H 85/02* (2006.01)
*H01H 73/22* (2006.01)
*H01H 69/02* (2006.01)

(52) U.S. Cl.
USPC ..... 337/297; 337/182; 337/183; 337/153; 29/623

(58) Field of Classification Search
USPC ..... 337/297, 182, 183, 153; 29/623
See application file for complete search history.

(56) References Cited

U.S. PATENT DOCUMENTS 2,171,864 A * 9/1939 Popp ..... 337/234
3,354,282 A * 11/1967 Batsch ..... 337/234

(Continued)

FOREIGN PATENT DOCUMENTS

CN 1381935 A 11/2002
JP 08-7731 A 1/1996

(Continued)

OTHER PUBLICATIONS

International Preliminary Report on Patentability (IPRP) dated Aug. 18, 2011 (and English translation thereof) in counterpart International Application No. PCT/JP2010/050336.

(Continued)

*Primary Examiner* — Bradley Thomas
(74) *Attorney, Agent, or Firm* — Holtz, Holtz, Goodman & Chick, PC

(57) ABSTRACT

A protection element is provided which is capable of stably retaining a flux on a soluble conductor at a predetermined position and is capable of checking a retention state of the flux, enabling a speedy blowout of the soluble conductor in the event of an abnormality. This protection element includes: a soluble conductor 13 which is disposed on an insulation baseboard 11 and is connected to an electric power supply path of a device targeted to be protected, to cause a blowout by means of a predetermined abnormal electric power; a flux 19 which is coated onto a surface of the soluble conductor 13; and an insulation cover 14 which is mounted on the baseboard 11 with the soluble conductor 13 being covered therewith. The insulation cover 14 is provided with an opening porting 20 made of a through hole which is opposite to the soluble conductor 13. The flux 19 comes into contact with a peripheral edge part of the opening portion 20, retaining the flux 19 at a predetermined position on the soluble conductor 13.

2 Claims, 5 Drawing Sheets

(56) References Cited

U.S. PATENT DOCUMENTS

| | | | | | |
|---|---|---|---|---|---|
| 4,198,617 | A * | 4/1980 | Hara | 337/403 |
| 4,893,106 | A * | 1/1990 | Goldstein et al. | 337/159 |
| 4,972,170 | A * | 11/1990 | Ehlmann et al. | 337/228 |
| 5,097,247 | A * | 3/1992 | Doerrwaechter | 337/405 |
| 5,252,942 | A * | 10/1993 | Gurevich | 337/163 |
| 5,270,679 | A * | 12/1993 | Gulbrandsen | 337/252 |
| 5,294,905 | A * | 3/1994 | Pimpis | 337/158 |
| 5,296,832 | A * | 3/1994 | Perreault et al. | 337/158 |
| 5,426,411 | A * | 6/1995 | Pimpis et al. | 337/186 |
| 5,631,621 | A * | 5/1997 | Nakajima | 337/280 |
| 5,659,284 | A * | 8/1997 | Olofsson | 337/290 |
| 5,712,610 | A * | 1/1998 | Takeichi et al. | 337/290 |
| 5,781,095 | A * | 7/1998 | Dietsch et al. | 337/243 |
| 5,821,849 | A * | 10/1998 | Dietsch et al. | 337/241 |
| 5,939,969 | A * | 8/1999 | Doerrwaechter et al. | 337/297 |
| 5,982,268 | A * | 11/1999 | Kawanishi | 337/297 |
| 5,994,993 | A * | 11/1999 | Castonguay et al. | 337/206 |
| 6,040,754 | A * | 3/2000 | Kawanishi | 337/297 |
| 6,198,376 | B1 * | 3/2001 | Ishikawa et al. | 337/297 |
| 6,222,438 | B1 * | 4/2001 | Horibe et al. | 337/290 |
| 6,300,859 | B1 * | 10/2001 | Myong et al. | 337/182 |
| 6,452,475 | B1 * | 9/2002 | Kawazu et al. | 337/290 |
| 6,456,189 | B1 * | 9/2002 | Mosesian et al. | 337/243 |
| 6,556,122 | B2 * | 4/2003 | Izaki et al. | 337/405 |
| 6,566,996 | B1 * | 5/2003 | Douglass et al. | 337/243 |
| 6,636,409 | B2 | 10/2003 | Kladar et al. | |
| 6,838,971 | B2 * | 1/2005 | Senda et al. | 337/296 |
| 7,473,487 | B2 * | 1/2009 | Senda et al. | 429/62 |
| 7,535,332 | B2 | 5/2009 | Furuuchi et al. | |
| 7,718,308 | B2 * | 5/2010 | Senda et al. | 429/62 |
| 2002/0014945 | A1 * | 2/2002 | Furuuchi et al. | 337/158 |
| 2002/0113685 | A1 * | 8/2002 | Izaki et al. | 337/405 |
| 2003/0156007 | A1 * | 8/2003 | Senda et al. | 337/401 |
| 2004/0070486 | A1 * | 4/2004 | Senda et al. | 337/405 |
| 2004/0085178 | A1 * | 5/2004 | Tanaka et al. | 337/159 |
| 2004/0100352 | A1 * | 5/2004 | Tanaka | 337/159 |
| 2004/0174243 | A1 * | 9/2004 | Tanaka | 337/159 |
| 2004/0196133 | A1 * | 10/2004 | Kawanishi | 337/159 |
| 2005/0001710 | A1 * | 1/2005 | Mukai et al. | 337/297 |
| 2005/0007233 | A1 * | 1/2005 | Tanaka | 337/159 |
| 2005/0264394 | A1 * | 12/2005 | Furuuchi | 337/182 |
| 2006/0097839 | A1 * | 5/2006 | Tanaka | 337/159 |
| 2007/0024407 | A1 * | 2/2007 | Senda et al. | 337/159 |
| 2010/0085141 | A1 * | 4/2010 | Knab et al. | 337/227 |
| 2010/0109833 | A1 * | 5/2010 | Knab et al. | 337/413 |
| 2011/0181385 | A1 * | 7/2011 | Schulze-Icking-Konert et al. | 337/290 |

FOREIGN PATENT DOCUMENTS

| | | | |
|---|---|---|---|
| JP | 2000-100290 | A | 4/2000 |
| JP | 2001-309551 | A | 11/2001 |
| JP | 2004-214032 | A | 7/2004 |
| JP | 2004-265617 | A | 9/2004 |
| JP | 2007-294117 | A | 11/2007 |

OTHER PUBLICATIONS

International Search Report (and English translation thereof) dated Feb. 9, 2010 in International Application No. PCT/JP2010/050336.

U.S. Appl. No. 13/145,455; First Named Inventor: Yuji Kimura; Title: "Protection Element", filed Jul. 20, 2011.

Chinese Office Action dated Apr. 3, 2013 (and English translation thereof) in counterpart Chinese Application No. 201080003219.7.

* cited by examiner

PROTECTION ELEMENT

TECHNICAL FIELD

The present invention relates to a protection element for, in case that an overcurrent or an overvoltage is applied to an electronic device or the like, allowing a soluble conductor to cause a blowout exerted by a heat of such an overcurrent or overvoltage and then to shut off a current.

BACKGROUND ART

Conventionally, a protection element which is mounted on a secondary battery device or the like is employed as the one that has a function of preventing an overvoltage as well as an overcurrent. This protection element is formed so that: a heating element and a soluble conductor made of a low-melting metal member are laminated on a board; the soluble conductor is blown out due to an overcurrent; and in case that an overvoltage is generated as well, power is supplied to the heating element in the protection element and then the soluble conductor is blown out due to a heat of the heating element. Blowout of the soluble conductor takes place due to goodness of wettability relative to a connected electrode surface at the time of blowout of the soluble conductor that is a low-melting metal. The low-melting metal that has been blown out is attracted onto an electrode, and as a result, the soluble conductor is broken and then a current is shut off.

On the other hand, with downsizing of an electronic device, such as a portable device, in recent years, a protection element of this type has been needed to be downsized or reduced in thickness; and there has been a further demand for operational stability and fastness. As a means therefor, there is provided the one in which a soluble conductor of a low-melting metal member is disposed on an insulation board; the disposed soluble conductor is sealed with an insulation cover; and a flux is coated onto the soluble conductor. This flux is adapted to prevent oxidization of a surface of the soluble conductor, and is provided so that the soluble conductor blows out speedily and stably at the time of heating the soluble conductor.

Such a protection element has a structure shown in FIG. 9. In this protection element, a pair of electrodes 2 is provided on a baseboard 1, and a pair of electrodes, although not shown, is provided at an opposite edge part which is orthogonal to the electrodes 2. A heating element 5 made of a resistor is provided between electrodes, although not shown, and a conductor layer 7 which is connected to one of a pair of electrodes, although not shown, via an insulation layer 6, is provided. At this protection element, a soluble conductor 3 made of a low-melting metal foil is provided between a pair of electrodes 2 that is formed on both ends of the baseboard 1. A center part of the soluble conductor 3 is provided on the conductor layer 7. Further, an insulation cover 4 is provided in face-to-face opposite to the soluble conductor 3 that is provided on the baseboard 1. The insulation cover 4 which is mounted on the baseboard 1 is put with a predetermined space 8 being formed relative to the soluble conductor 3. A flux 9 is applied to the soluble conductor 3, and the flux 9 is housed in the space 8 which is provided in the insulation cover 4.

In addition, a protection element having a soluble conductor which is sealed with an insulation cover has a structure disclosed in Patent Document 1. In this protection element, a space in which a fused metal gathers on an element at the time of blowout of the soluble conductor is small due to reduction in thickness, and thus, in order to ensure drawing of the fused metal into each electrode portion, a metal pattern with its good wettability relative to the fused metal is provided at a site which is face-to-face opposite to each electrode on an interior face of the insulation cover so that the fused metal is speedily drawn into each electrode forming portion.

Moreover, as disclosed in Patent Document 2, there is proposed the one in which: a flux is coated onto a soluble alloy piece in order to prevent a difference in operation temperature; and a belt member of groove or glass for preventing wetting and spreading of a fused alloy is provided at the periphery of an electrode to which a soluble alloy is connected.

PRIOR ART LITERATURE

Patent Documents

[Patent Document 1] Japanese Patent Application Laid-open No. 2004-265617

[Patent Document 2] Japanese Patent Application Laid-open No. 2007-294117

SUMMARY OF THE INVENTION

Problems to be Solved by the Invention

In the aforementioned one shown in FIG. 9, described above, or in the protection elements disclosed in Patent Documents 1 and 2, a flux functions as an activator for preventing oxidization of a soluble conductor and for causing a blowout at an abnormal current or voltage, and a retention state of the flux occasionally has influenced an operation speed. In particular, in a case where a halogen-free flux which does not contain a halogen component such as boron (Br) is used in order to mitigate an environmental burden, the flux of this type is low in degree of activity, and the state of the flux greatly has influenced a blowout speed of the soluble conductor.

That is, as shown in FIG. 10, in an insulation cover 4, a flux 9 on a soluble conductor 3 is not stably retained at a center part of a space 8 and then is unevenly distributed at any of the left and right. In such a case, there emerges a circumstance that: a fused metal of the soluble conductor 3 is likely to easily flow into a location in which the flux 9 has been retained; and the soluble conductor 3 is hardly fused at a portion at which the flux 9 has been insufficient, and there has arisen a problem that time taken for reliable blowout is extended.

Further, as in the invention set forth in Patent Document 1, in a structure in which a metal pattern is formed on an insulation cover, or alternatively, as in the invention set forth in Patent Document 2, in a structure in which a groove or a belt member is provided at the periphery of an electrode, a flux on a soluble conductor cannot be stably retained. Moreover, in a method of forming a metal pattern on an insulation cover, in the structure disclosed in Patent Document 1, there is a need to print the metal pattern after molding the insulation cover, and then, material costs increase. Similarly, in the structure disclosed in Patent Document 2 as well, a belt member of groove or glass must be provided for preventing spread wetting of a fused alloy at the periphery of an electrode to which a soluble alloy has been connected, which increases in cost. In addition, in the structure of Patent Document 1, when an insulation cover side causes a thermal deformation or the like, a distance from the insulation cover becomes shorter, whereby the metal pattern of the insulation cover and the electrode may be shorted.

Moreover, while it is essential to stably retain a position of the flux 9 at a center part as described above, there has been a demand to check to see if the flux 9 stays at the center part or if the flux per se is coated, since its internal state cannot be identified after the insulation cover 4 has been put.

The present invention has been made in view of the above-described background art, and it is an object of the present invention to provide a protection element which is capable of stably retaining a flux provided on a soluble conductor at a predetermined position and is capable of checking a retention state of the flux, enabling a speedy blowout of the soluble conductor in the event of an abnormality.

Means for Solving the Problem

The present invention is directed to a protection element including: a soluble conductor which is disposed on an insulation baseboard and is connected to an electric power supply path of a device targeted to be protected, to cause a blowout by means of a predetermined abnormal electric power; an insulation cover which is mounted on the baseboard with the soluble conductor being covered via a predetermined space; and a flux which is coated onto a surface of the soluble conductor and is positioned in the space, the protection element being adapted for, in case that the abnormal electric power is supplied to the device targeted to be protected, allowing the soluble conductor to blow out and shut off a current path thereof, wherein: an opening portion made of a through hole is formed at the insulation cover in opposite to the soluble conductor; the flux comes into contact with a peripheral edge part of the opening portion; and the flux is provided on the soluble conductor so as to be retainable at a predetermined position in the space.

The opening portion is made of an opening portion of a large diameter, which is formed at a center part of the insulation cover and is formed in face-to-face opposite to a center part of the soluble conductor. Further, the opening portion may be coated with a transparent film.

In addition, the opening portion may be formed in plurality at the insulation cover. Further, a plurality of the opening portions may be coated with a transparent film.

Effect of the Invention

According to a protection element of the present invention, an opening portion is provided at an insulation cover, thus enabling a flux to be retained reliably stably at a peripheral edge part of the opening portion. In this manner, in particular, in a case where a flux with its low degree of activity (such as a halogen-free flux) is used, it is possible to prevent uneven distribution of the degree of activity due to bias of the retention state after coating the flux, and in blowout operation of a soluble conductor, in particular, in heat generation operation characteristics of low electric power, an operational distortion can be remarkably reduced. Moreover, by employing the halogen-free flux, it becomes possible to provide a protection element with its small environmental burden. In addition, the opening portion is provided at the insulation cover, thereby making it possible to visually check the flux for internal appearance.

BEST MODES FOR CARRYING OUT THE INVENTION

Figure 1:
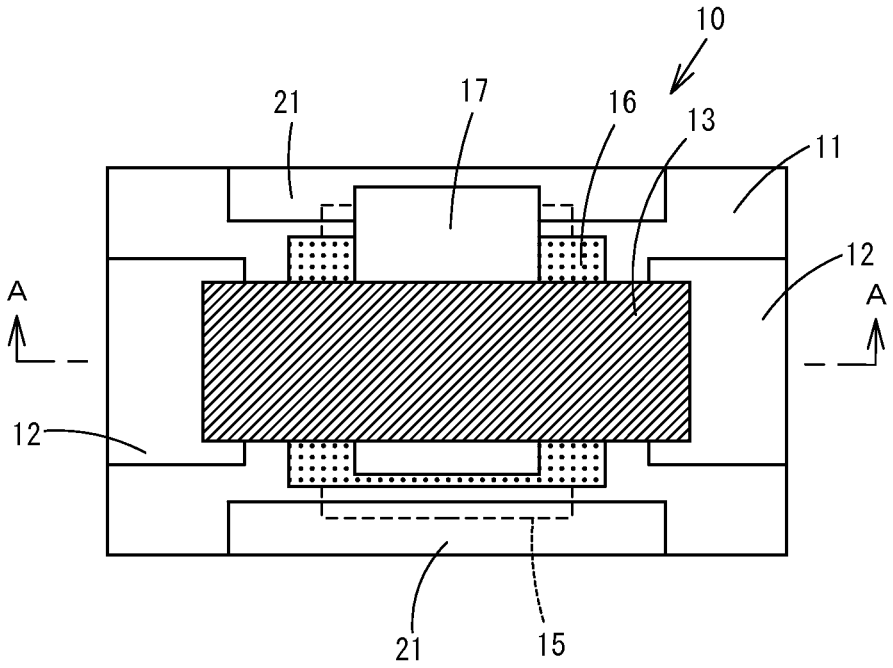
FIG. 1 It is a plan view of a state in which an insulation cover is removed from a protection element according to a first embodiment of the present invention.

Hereinafter, a first embodiment of a protection element of the present invention will be described with reference to FIGS. 1 to 4. In a protection element 10 of the embodiment, a pair of electrodes 12 is provided at both ends of a top face of an insulation baseboard 11, and the other pair of electrodes 21 is provided at opposite edge parts which are orthogonal to the pair of electrodes 12. A heating element 15 made of a resistor is connected to the pair of electrodes 21, and on the heating element 15, a conductor layer 17 which is connected to one of the electrodes 21 is laminated via an insulation layer 16. In addition, a solder paste, although not shown, is coated onto the conductor layer 17 and the pair of electrodes 12, and a soluble conductor 13 which is a fuse made of a low-melting metal is connected and fixed thereto via the solder paste. Further, on the baseboard 11, an insulation cover 14 as an insulation member is mounted in face-to-face opposite to the soluble conductor 13.

Here, as a material for the baseboard 11, any kind of material may be employed as long as it has an insulation property, and for example, an insulation board employed for a printed wiring board, such as a ceramic board or a glass epoxy board, is preferable. Moreover, a glass board, a resin board, an insulation processing metal board or the like can be employed according to its appropriate usage, whereas a ceramic board with its superior heat resistance and its good thermal conductivity is further preferable.

As the electrodes 12, 21 and the conductor layer 17, there can be used a metal foil such as copper or a conductor material whose surface is plated with Ag—Pt, Au, or the like. In addition, there may be employed: a conductor layer or an electrode obtained by coating and firing an electrically conductive paste, such as an Ag paste; or alternatively, a metal thin-film structure obtained by evaporation or the like.

As a low-melting metal for the soluble conductor 13, any kind of material can be employed as long as it is fused at a predetermined electric power, and as a material for fuse, a variety of low-melting metals which are publicly known can be used. For example, a BiSnPb alloy, a BiPbSn alloy, a BiPb alloy, a BiSn alloy, a SnPb alloy, a SnAg alloy, a PbIn alloy, a ZnAl alloy, an InSn alloy, a PbAgSn alloy or the like can be employed.

A resistor forming the heating element 15 is obtained by coating and firing a resistance paste made of an electrically conductive material such as ruthenium oxide or carbon black and an inorganic binder such as glass or an organic binder such as thermosetting resin. In addition, this resistor may be formed by printing and firing a thin film of ruthenium oxide or carbon black or by means of plating, evaporation, or sputtering, or alternatively, may be formed by attaching or laminating a film of these resistor materials, for example.

The insulation cover 14 that is mounted on the baseboard 11 is formed in a box shape which opens at one side face part, and is put on the baseboard 11 with a predetermined space 18 being formed relative to the soluble conductor 13. On the insulation cover 14, a concentrically circular opening portion 20 is formed at a position which is opposite to a center part of the soluble conductor 13. The opening portion 20 is formed so that a projection position for the baseboard 11 surrounds a center part of the heating element 15.

As a material for the insulation cover 14, any kind of insulation material may be employed as long as it has heat resistance which is resistive to a heat at the time of blowout of the soluble conductor 13, the insulation material having a mechanical strength which is suitable for the protection element 10. A variety of materials such as board materials employed for printed wiring boards, such as glass, ceramics, plastics, or glass epoxy resin, for example, can be applied. Further, an insulation layer such as an insulation resin may be formed on a face which is face-to-face opposite to the baseboard 11, by employing a metal plate. Preferably, a material with its mechanical strength and its high insulation property like ceramics is preferable, since it contributes to thickness reduction of the entire protection element as well.

Figure 2:
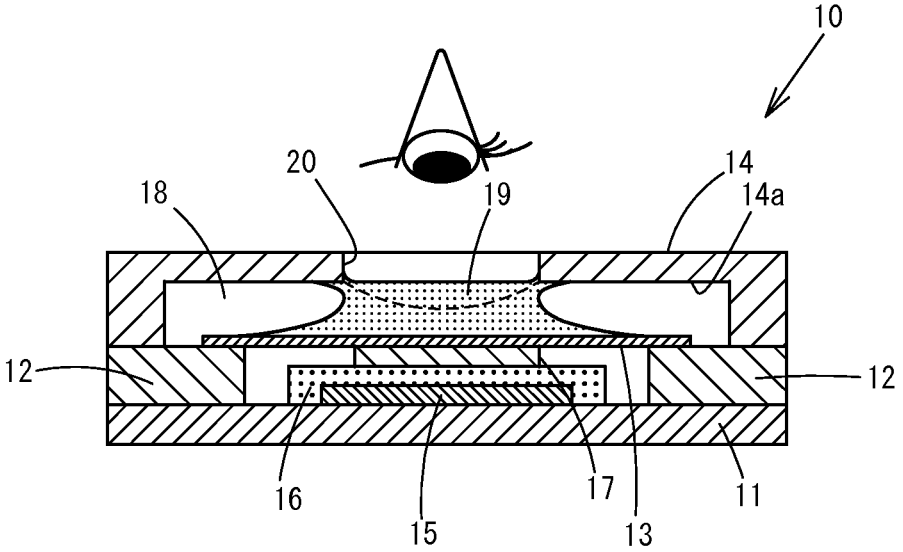
FIG. 2 It is a sectional view taken along the line A-A of FIG. 1, of a state in which the insulation cover is mounted thereon.
Figure 3:
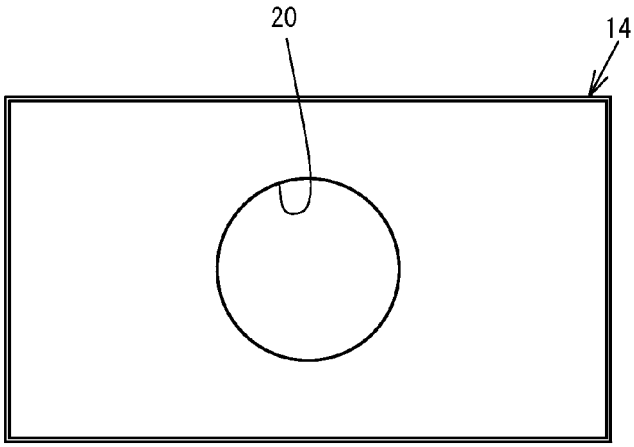
FIG. 3 It is a plan view of the insulation cover of the embodiment.

On an entire surface of the soluble conductor 13, a flux 19 is provided in order to prevent oxidization of the surface. As the flux 19, a halogen-free flux which does not have a halogen element such as boron is preferable. The flux 19 is retained on the soluble conductor 13 by means of surface tension, and is housed in the space 18; and as shown in FIG. 2, the housed flux adheres to the peripheral edge part and the interior face 14*a* of the opening portion 20 that is formed on the insulation cover 14, and then, the resultant flux 19 is stably retained due to its wettability and surface tension. In this manner, the flux 19 is stably retained without being displaced from the center part of the soluble conductor 13. A solvent in the flux 19 evaporates from the opening portion 20, and as indicated by the dashed line, a surface of the flux 19 is formed in an archery-like recessed shape.

Figure 4:
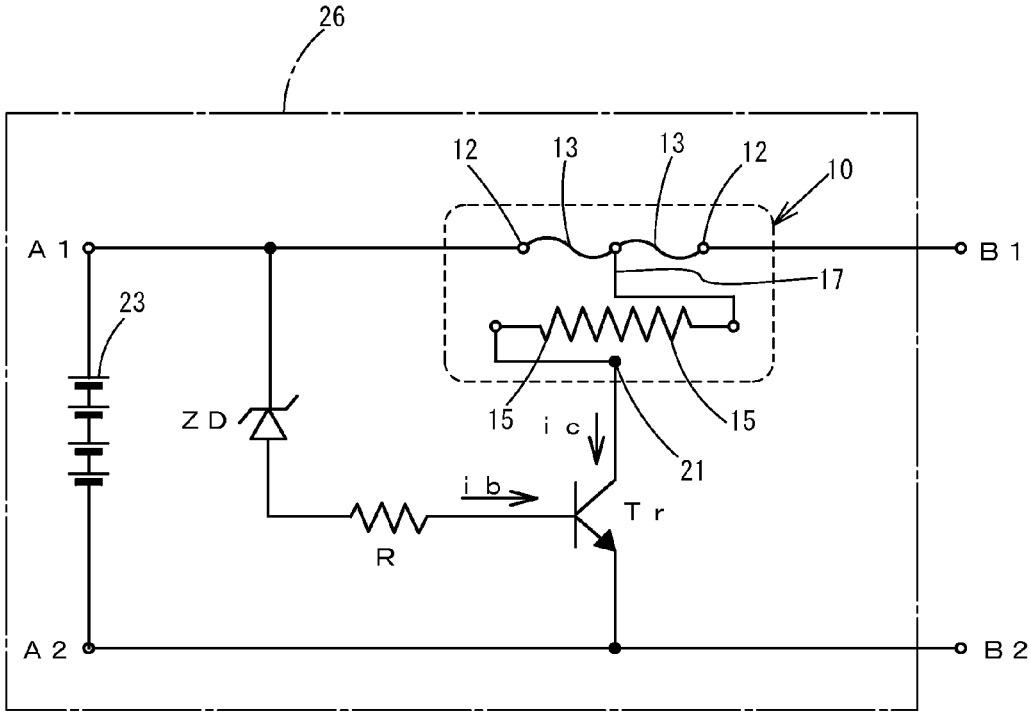
FIG. 4 It is a circuit diagram showing an example of using the protection element according to the first embodiment of the present invention.

Next, as an example of employing the protection element 10 of the embodiment in an electronic device, an overcurrent or overvoltage protection circuit 26 of a secondary battery device will be described with reference to FIG. 4. In this overcurrent or overvoltage protection circuit 26, a pair of electrodes 12 of the protection element 10 is connected in series between an output terminal A1 and an input terminal B1, one terminal of the pair of electrodes 12 of the protection terminal 10 is connected to the input terminal B1, and the other electrode 12 is connected to the output terminal A1. In addition, a neutral point of the soluble conductor 13 is connected to one end of the heating element 15, and one terminal of the electrode 21 is connected to the other terminal of the heating element 15. The other terminal of the heating element 15 is connected to a collector of a transistor Tr, and an emitter of the transistor Tr is connected between the other output terminal A2 and input terminal B2. Further, an anode of a Zener diode ZD is connected to a base of the transistor Tr via a resistor R, and a cathode of the Zener diode ZD is connected to the output terminal A1. The resistor R is set at a value such that when a predetermined value set to be abnormal is applied between the output terminals A1 and A2, a voltage beyond a breakdown voltage is applied to the Zener diode ZD.

Electrode terminals of a secondary battery 23 which is a device targeted to be protected, such as a lithium ion battery, for example, are connected between the output terminals A1 and A2, and electrode terminals of a device such as a battery charger, although not shown, which is to be used to be connected to the secondary battery 23, are connected to the input terminals B1 and B1.

Next, a protection operation of the protection element 10 of the embodiment will be described. In a secondary battery device such as a lithium ion battery; on which the overcurrent or overvoltage protection circuit 26 of the embodiment has been mounted, if an abnormal voltage is applied to the output terminals A1 and A2 at the time of power charging thereof, an inversed voltage which is equal to or greater than a breakdown voltage is applied to the Zener diode ZD at a predetermined voltage which is set to be abnormal, and then, the Zener diode ZD is made conductive. By making the Zener diode ZD conductive, a base current ib flows into a base of a transistor TR, whereby a transistor Tr is turned on, a collector current is flows into the heating element 15, and then, the heating element 15 generates a heat. This heat is transmitted to the soluble conductor 13 of a low-melting metal on the heating element 15, the soluble conductor 13 blows out, and then, an electric conduction between the input terminal B1 and the output terminal A1 is shut off, preventing an overvoltage from being applied to the output terminals A1 and A2.

At this time, the flux 19 is retained at the center part of the soluble conductor 13, and blows out speedily and reliably at a predetermined blowout position. In addition, in case that an abnormal current flows toward the output terminal A1 as well, the soluble conductor 13 is set so as to generate a heat and then blow out due to the current.

According to the protection element 10 of the embodiment, the opening portion 20 is provided at the insulation cover 14, making it possible to check to see if the flux 19 reliably stays at a center part through the opening portion 20. Further, the flux 19 is retained at a peripheral edge part of the opening portion 20, enabling the flux 19 to be stably retained at a predetermined position of the center part of the soluble conductor 13. In this manner, in particular, in a case where a flux 19 such as a halogen-free flux with its low degree of activity is used as well, unstableness of the flux action due to bias or distortion of a coating state of the flux 19 can be prevented, ensuring blowout of the soluble conductor 13.

Figure 5:
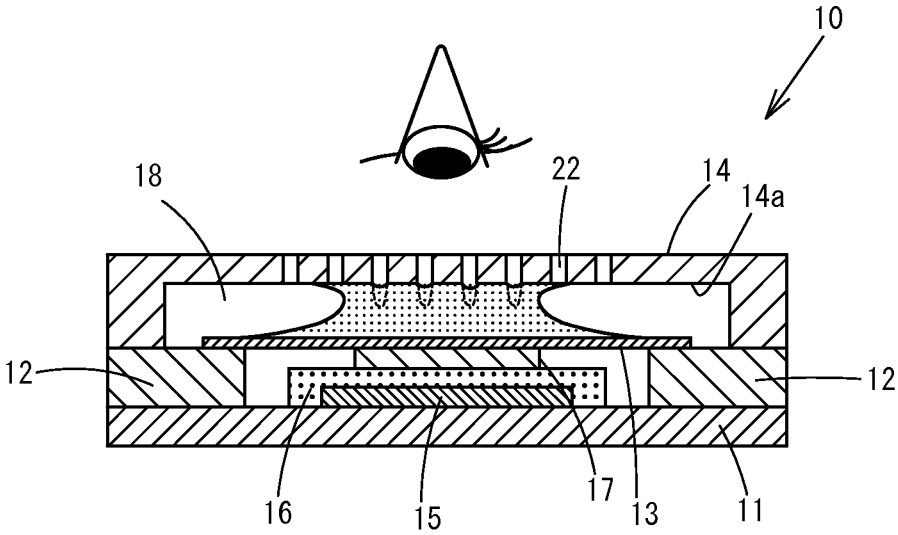
FIG. 5 It is a longitudinal cross section of a second embodiment of the present invention.
Figure 6:
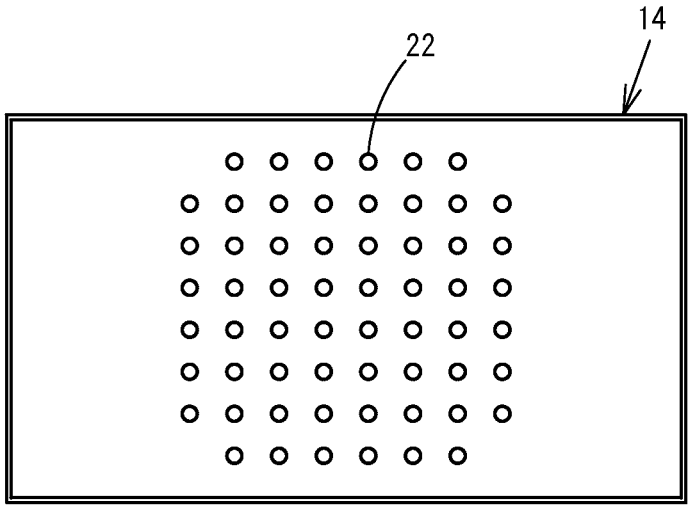
FIG. 6 It is a plan view of an insulation cover according to the second embodiment of the present invention.

Next, a second embodiment of a protection element of the present invention will be described with reference to FIGS. 5 and 6. Herein, like constituent elements in the above-described embodiment are designated by like reference numerals, and a duplicate description is omitted. According to a protection element 10 of the embodiment, opening portions 22 which are a number of small through holes are formed at an insulation cover 14. A solvent in the flux 19 evaporates from the opening portions 22, and as indicated by the dashed line, a surface of the flux 19 is formed in an archery-like recessed shape for each of the opening portions 22.

The opening portions 22 may be formed at the periphery of the opening portion 20 of its larger diameter, according to the first embodiment, which is formed at the center part of the insulation cover 14.

By means of the protection element 10 of the embodiment as well, like the above-described embodiment, the flux 19 is reliably retained at a predetermined position, ensuring blowout operation of the soluble conductor 13. Further, a retention state of the flux 19 can be visually checked by naked eyes through the opening portions 22, enabling easy and reliable product check.

Figure 7:
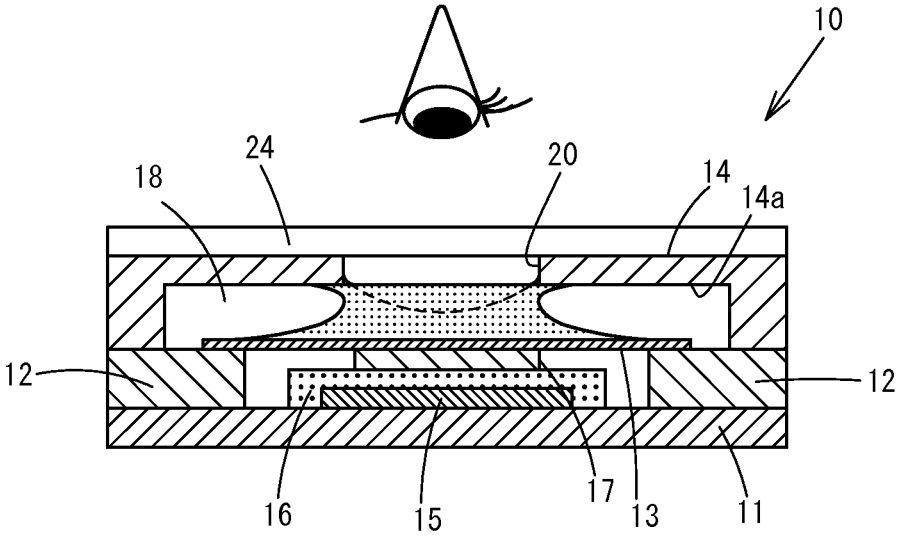
FIG. 7 It is a longitudinal cross section of a third embodiment of the present invention.
Figure 8:
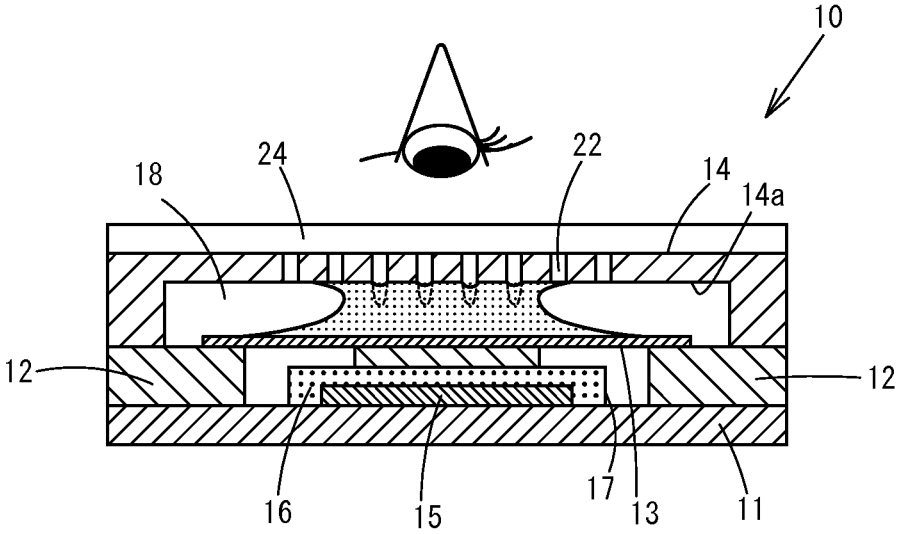
FIG. 8 It is a longitudinal cross section of a modification example according to the third embodiment of the present invention.
Figure 9:
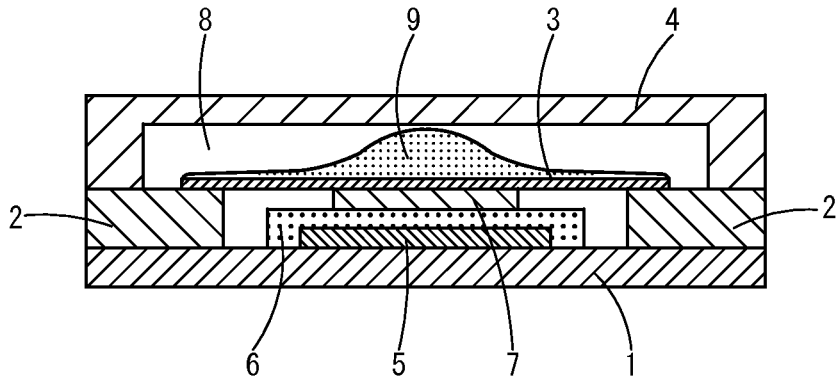
FIG. 9 It is a longitudinal cross section of a conventional protection element.
Figure 10:
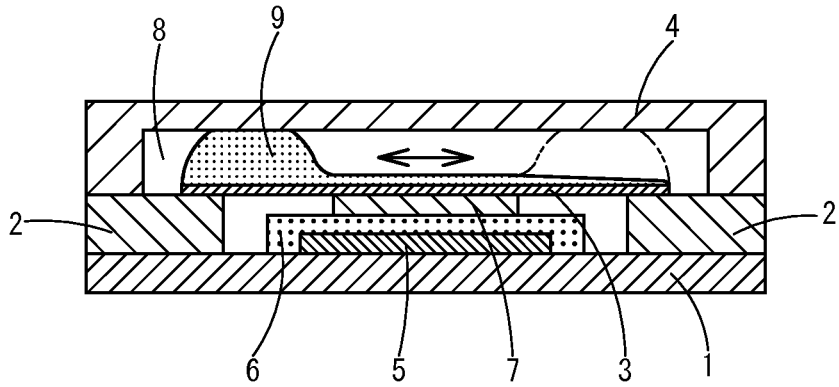
FIG. 10 It is a longitudinal cross section showing an appearance of a flux of the conventional protection element.

Next, a third embodiment of a protection element of the present invention will be described with reference to FIG. 7. Herein, like constituent elements in the above-described embodiments are designated by like reference numerals, and a duplicate description is omitted. In an insulation cover 14 of the embodiment of the present invention, as in the above-described embodiments, an opening portion 20 is formed at the insulation cover 14, and a transparent film 24 is attached onto a surface of the insulation cover 14. In addition, as shown in FIG. 8, while opening portions 22 made of a plurality of through holes are formed, the transparent film 24 may be attached onto the surface of the insulation cover 14.

By means of the protection element 10 of these embodiments as well, in addition to the advantageous effects that are similar to those of the above-described embodiments, the retention state of the flux 19 can be visually checked by naked eyes, and moreover, the film 24 serves to prevent dust or the like from adhering to the flux 19 through the opening portions 20, 22 or from entry into the protection element.

The protection element of the present invention is not limited to the above-described embodiments, and an opening portion as a through hole may be provided at an insulation cover, irrespective of any shape or number thereof. As a material for the flux or insulation cover, any kind of material can be selected as long as it functions properly.

The invention claimed is:

1. A protection element for protecting a device to be protected, the protection element comprising:

an insulation baseboard;

a pair of electrodes provided at both ends of a top face of the insulation baseboard;

a low-melting metal conductor which is disposed on the insulation baseboard, and which is adapted to be connected to an electric power supply path of the device to be protected, wherein the low-melting metal conductor is adapted to cause a blowout by means of a predetermined abnormal electric power, and the protection element is adapted to allow the low-melting metal conductor to blow out and shut off a current path thereof if the abnormal electric power is supplied to the device to be protected;

an insulation cover which is mounted on the baseboard so as to cover the low-melting metal conductor with a predetermined space therebetween; and a flux which is coated onto a surface of the low-melting metal conductor and is positioned in the space, wherein:

the insulation cover mounted on the insulation baseboard is formed in a box shape which opens at one side face part;

an opening portion comprising a through hole is formed in the insulation cover opposite to the low-melting metal conductor;

the opening portion comprises a concentrically circular opening portion of a large diameter which is formed at a center part of the insulation cover and is arranged face-to-face opposite to a center part of the low-melting metal conductor;

the opening portion is covered with a transparent film;

the opening portion is formed so that a projection position for the insulation baseboard surrounds the center part of the low-melting metal conductor;

the flux is arranged to be in contact with a peripheral edge part of the opening portion and is retained at the peripheral edge part due to its wettability and surface tension; and the flux is provided on the low-melting metal conductor so as to be retained at a predetermined position in the space.

2. A protection element for protecting a device to be protected, the protection element comprising:

an insulation baseboard;

a pair of electrodes provided at both ends of a top face of the insulation baseboard;

a low-melting metal conductor which is disposed on the insulation baseboard, and which is adapted to be connected to an electric power supply path of the device to be protected, wherein the low-melting metal conductor is adapted to cause a blowout by means of a predetermined abnormal electric power, and the protection element is adapted to allow the low-melting metal conductor to blow out and shut off a current path thereof if the abnormal electric power is supplied to the device to be protected;

an insulation cover which is mounted on the baseboard so as to cover the low-melting metal conductor with a predetermined space therebetween; and a flux which is coated onto a surface of the low-melting metal conductor and is positioned in the space, wherein:

the insulation cover mounted on the insulation baseboard is formed in a box shape which opens at one side face part;

an opening portion comprising a through hole is formed in the insulation cover opposite to the low-melting metal conductor;

the flux is arranged to be in contact with a peripheral edge part of the opening portion and is retained at the peripheral edge part due to its wettability and surface tension;

the flux is provided on the low-melting metal conductor so as to be retained at a predetermined position in the space;

the opening portion comprises a plurality of opening portions in the insulation cover, and is arranged face-to-face opposite to a center part of the low-melting metal conductor;

the plurality of opening portions are covered with a transparent film; and the plurality of opening portions are formed so that a projection position for the insulation baseboard surrounds the center part of the low-melting metal conductor.

* * * * *